US005688287A

United States Patent [19]

Cline

[11] Patent Number: 5,688,287

[45] Date of Patent: Nov. 18, 1997

[54] LEG FOR BOX SPRINGS

[75] Inventor: David Cline, Kentfield, Calif.

[73] Assignee: Rid-Gid Products, Inc., San Francisco, Calif.

[21] Appl. No.: 687,254

[22] Filed: Jul. 25, 1996

[51] Int. Cl.[6] ..... A47C 19/00; A47C 23/00

[52] U.S. Cl. ..... 5/310; 108/154; 248/188

[58] Field of Search ..... 5/310, 200.1, 400, 5/236.1; 108/154, 158; 248/188

[56] References Cited

U.S. PATENT DOCUMENTS

| | | | |
|---|---|---|---|
| 2,565,613 | 8/1951 | Ludwig | 5/310 |
| 2,598,105 | 5/1952 | Bolling | 5/310 |
| 2,784,930 | 3/1957 | Wernecke | 5/310 |
| 3,131,899 | 5/1964 | Luhrs | 248/188 |
| 3,142,467 | 7/1964 | Mutchnick et al. | 248/188 |
| 3,179,365 | 4/1965 | Holtz | 248/188 |
| 3,750,201 | 8/1973 | Usami | 5/310 |

FOREIGN PATENT DOCUMENTS

| | | | |
|---|---|---|---|
| 896578 | 5/1962 | United Kingdom | 248/188 |

*Primary Examiner*—Alexander Grosz

*Attorney, Agent, or Firm*—Phillips, Moore, Lempio & Finley

[57] ABSTRACT

A bed support for use with box springs is disclosed which consists of a plate member for fixture to a box springs and a leg. The plate member has a relatively large threaded bore through the center to threadably receive a threaded leg portion extending downwardly from the plate member. The leg portion includes an enlarged foot having a smooth bottom.

12 Claims, 1 Drawing Sheet

LEG FOR BOX SPRINGS

The need to support a bed a relative distance above the floor level is necessitated for several reasons. The first and foremost is beds that are too close to the floor; this occurs if the box spring and mattress are set directly on the floor, are difficult to get in and out of, particularly for elderly people. Secondly, a raised bed permits easier cleaning of the floor under the bed, since vacuum cleaners and the like may be extended at least partially under the bed without moving the bed. Thirdly, and in particular, in the home environment, the space under the bed may be used as additional storage space.

The conventional method of raising a bed above the floor level is to use either a conventional bed frame with a headboard, footboard and two side boards. The mattress and box springs are supported by lateral members passing between the two side boards. This is the traditional bed, which finds its origin in antiquity. More recently, the footboard and side boards have disappeared, to be replaced by a metal bed frame, usually made of two angle iron members that run longitudinally from the headboard to the foot of the mattress, with cross members both at the head and the foot of the bed. Legs, usually with casters, are affixed to the bed frame to give the necessary height to the bed springs and mattress.

While this system has been in common use in the residential-type bed for a number of years, the use of bed frames in hotels and other commercial lodging facilities has not always proved appropriate. The disassembly of the bed frame when moving a bed from one location to another, i.e., from one room to another, is burdensome. Further, the use of casters in the hotel environment serves to damage carpets due to the necessity of moving the bed each day when the room is cleaned. A bed frame on casters also has a tendency to scar the wall adjacent the bed because of its somewhat unstable nature. Further, metal bed frames are noisy and, by their nature, they put the room occupants in jeopardy with sharp edges.

Accordingly, approximately twenty years ago bed legs made of plastic materials were introduced into the marketplace. These plastic legs, which are sold under the trade name Rid-Gid Glide®, can be screwed directly to the box springs, giving the necessary height and support to the frame. These legs are sold by the assignee of this invention. The plastic legs carry an expanded foot made of smooth, molded plastic so that the bed could be easily moved across a carpet. If it becomes necessary to move the bed from room to room, the legs attached to the box springs do not have to be separated from the bed; however, the legs do present a protrusion that must be maneuvered about a door frame.

A major drawback to the plastic legs screwed to the bed frame was that each individual box springs had to be fitted with the legs upon arrival at the hotel or other lodging facility prior to the time it could be put into use. While this may sound like a relatively minor project, it must be multiplied by a factor of six. For example, a typical installation of a twin or double bed requires six of these legs. In the conventional queen size bed, ordinarily nine legs are recommended, while in the king size bed, up to twelve legs are recommended.

The new plastic leg eliminated the noisy bed frames and avoided injury to people's shins in making the bed. Furthermore, these glide type legs replaced the expensive casters that needed to be replaced periodically. The biggest disadvantage of the glide leg described above is that it had to be installed on-site simply because the box springs manufacturers cannot package the box springs with the legs installed.

Accordingly, it is an object of this invention to provide a bed support which can, at least in part, be mounted on the box spring at the time of manufacture.

It is another object of this invention to retain the utilitarian functions of existing glide-type bed legs while providing the user with a removable leg.

It is still another object of this invention to provide a bed leg that is easily removable.

This invention is a bed support for a box springs consisting of a plate member and a leg. The plate member is fixable to the bottom of the box springs and defines therethrough a central threaded bore. The leg defines a foot end and a threaded opposite end such that the threaded opposite end is adapted to be threadedly received in the central threaded bore of the plate member.

DETAILED DESCRIPTION OF THE PREFERRED EMBODIMENT

Figure 1:
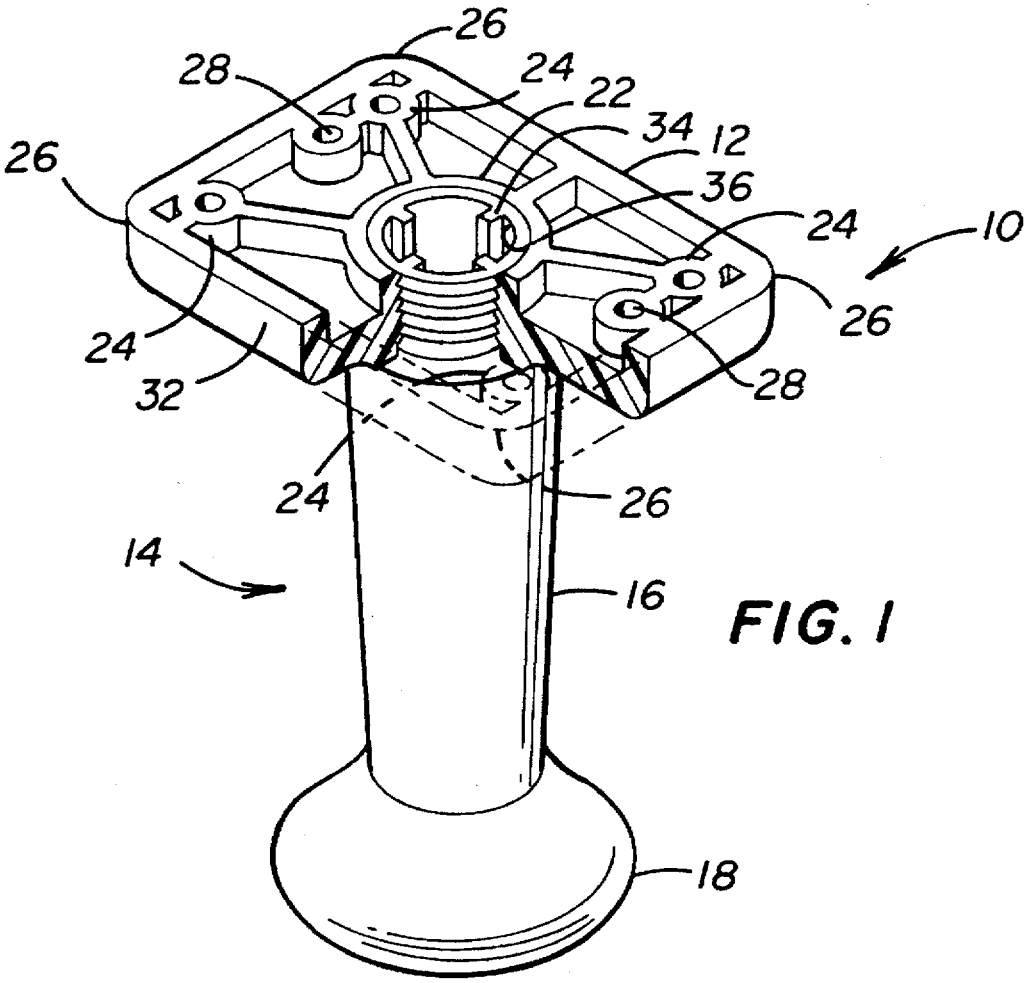
FIG. 1 is a perspective view partially in section of the assembled bed support or bed leg.

Referring to FIG. 1, a bed support 10 is shown in perspective. Bed support 10 consists of a plate member 12 and a leg 14. Leg 14 consists of an upper portion 16 and a foot portion 18. In addition, leg 14 defines at the upper end of upper portion 16 an integral threaded member 20.

Plate member 12 is generally rectangular in shape, as shown in FIG. 1, and includes a threaded bore 22 formed to threadably receive threaded member 20 of leg 14, as best shown in FIG. 1. Plate member 12 further includes a plurality of holes, including a set 24 which are located immediately adjacent of the corners 26 of plate member 12. In addition to the set of holes 24, two additional holes 28 are located at the ends of the rectangular plate member between the holes 24.

Figure 2:
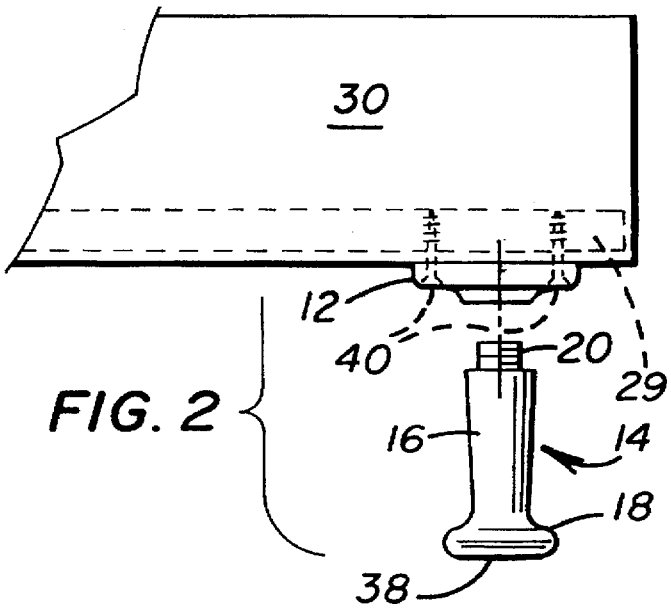
FIG. 2 is an elevation view showing the box spring with the bed support plate affixed thereto, and the leg separated from the plate to show how the bed support assembly can be disassembled.

As depicted in FIG. 1, it can be seen that the holes 28 are closer to one side of the rectangular plate member than the other, so that when it becomes necessary to mount plate member 12 to a box spring 30, as shown in FIG. 2, a choice is provided to the manufacturer based on the construction of the box spring. Specifically, box springs are usually made with either three-inch wide horizontal support members 29 in the base, or four-inch wide horizontal support members 29 in the base. The set of holes 24 in its entirety may be used for the four-inch support members, while the two holes 24 adjacent side 32 of plate member 12, along with the two holes 28, may be utilized for the three-inch wide support member 29 in the box springs 30. Screws 40 can be used to fix plate member 12 to box springs 30. It should be noted that two screws would suffice to hold plate member 12 to the box springs, but four screws are preferable.

It can be seen in FIG. 1 that plate member 12, if made of plastic, which is the preferred material, will contain a plurality of stiffening members. The use of the stiffening members is necessitated because in molding plastics, a large volume piece such as plate member 12 cannot be readily molded of a solid piece of plastic but rather requires the use of voids so that the plastic does not deform in the cooling process. If plate member 12 were made of cast metal, these stiffeners as shown in FIG. 1 might not be necessary; however, in order to lighten the overall weight of the plate member 12, if it were made of metal, it would probably be appropriate to include the voids as shown in FIG. 1.

Figure 3:
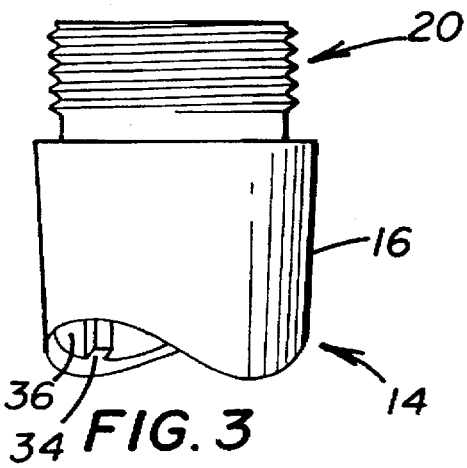
FIG. 3 is the upper portion of the leg showing the threaded end thereof.

Leg 14 is also preferably manufactured of a molded plastic including the threaded portion 20 of the leg 16. The leg tapers from the plate member end or threaded portion end toward the foot 18 for ease in withdrawing the leg from the mold, but equally important, for aesthetic purposes. It should be noted that the leg is hollow, as best shown in FIG. 3, with stiffeners 34 on the inner bore 36 of leg 14. Again, these stiffeners are necessitated by the material which leg 14 is made of and also to provide the necessary strength to that leg.

Foot 18 is circular in shape and may be molded separately from the upper portion 16 to reduce the cost of rather expensive plastic injection molding dies. The foot portion 18 conforms to the existing plastic legs now in the marketplace, sold under the name Rid-Gid Glide® by the assignee of the present invention. The foot portion 18 includes a smooth bottom 38 which permits the bed, when the bed supports are affixed to the box springs, to be moved over a carpet without damage to the carpet.

In use, the plate member 12 may be affixed to the box springs 30 at the manufacturing facility of the box springs. Sufficient plate members 12 are affixed to the bottom of the box springs so that adequate support is provided to the bed when in use. As noted in the Background of the Invention, up to twelve supports can be used, depending upon the size of the bed.

The manufacturer can then package the box springs 30 in the normal manner with only a slight increase in the package size necessitated by the plate member 12 extending downwardly from the box springs. In actuality, this additional packaging would amount to less than one inch in depth of the box springs. The leg 14 can either be shipped with the package of the box springs 30, or can be provided separately.

Should the ultimate purchaser of the box springs desire to use the box springs on a conventional bed frame, the plate members 12 can be removed.

Upon arrival at the ultimate user's site, the box springs 30 is taken from its package and the legs 14 are screwed into the respective plate member 12 and the plate member 12 is then positioned with the legs extending downwardly from it, generally in the manner shown in FIG. 2.

This invention is to be limited only by the claims that follow herewith.

What is claimed is:

1. A support for the box springs of a bed comprising:

a rectangular plate member defining a central threaded bore;

a leg;

fastening means for fixing said plate member to said box springs;

said rectangular plate member defining four corners, six holes, a first edge, and an opposing second edge, each of four of said six holes adjacent one of said corners of said rectangular plate member, such that two of said four holes are adjacent said first edge and the other two of said four holes are adjacent said opposing second edge, the remaining two of said six holes positioned a predetermined distance in from said first edge of said rectangular plate member;

said leg defining a foot end and an integral threaded opposite end, said threaded end adapted to be threadably received in said central threaded bore of said plate member.

2. The bed support of claim 1, wherein said fastening means includes at least two screws, said at least two screws for passing through two of said six holes defined by said plate member to affix said plate to said box springs.

3. The bed support of claim 2, wherein the foot end of said leg is enlarged and defines a flat bottom portion.

4. The bed support of claim 1, wherein said fastening means includes four screws, said four screws for passing through four of said six holes to affix said plate to the box springs.

5. The bed support of claim 4, wherein the foot end of said leg is enlarged and defines a flat bottom portion.

6. The bed support of claim 4, wherein the four of said six holes through which said four screws are passed consist of the four holes adjacent to said four corners of said rectangular plate member.

7. The bed support of claim 6, wherein the foot end of said leg is enlarged and defines a flat bottom portion.

8. The bed support of claim 4, wherein the four of said six holes through which said four screws are passed consist of said two holes adjacent said second opposing edge of said plate member and said two holes positioned a predetermined distance in from said first edge.

9. The bed support of claim 8, wherein the foot end of said leg is enlarged and defines a flat bottom portion.

10. The bed support of claim 1, wherein the foot end of said leg is enlarged and defines a flat bottom portion.

11. The bed support of claim 1, wherein said leg has a middle section, said middle section connecting said foot end and said threaded opposite end of said leg, said middle section having a first diameter, said threaded opposite end of said leg having a second diameter, such that said second diameter is smaller than said first diameter by a relatively small margin.

12. The bed support of claim 11, wherein the foot end of said leg is enlarged and defines a flat bottom portion.

* * * * *